US005847497A

United States Patent [19]

Mehrotra et al.

[11] Patent Number: 5,847,497

[45] Date of Patent: Dec. 8, 1998

[54] MULTIPLE LAYER COMPOSITE ELECTRODES FOR DISCHARGE LAMPS AND LOW TEMPERATURE CO-SINTERING METHOD FOR PRODUCING THE SAME

[75] Inventors: Vivek Mehrotra, Rye Brook, N.Y.; Hemant S. Betrabet, Veldhoven, Netherlands; Susan McGee; Thomas F. McGee, both of Peekskill, N.Y.

[73] Assignee: Philips Electronics North America Corporation, New York, N.Y.

[21] Appl. No.: 832,895

[22] Filed: Apr. 3, 1997

Related U.S. Application Data

[62] Division of Ser. No. 363,184, Dec. 23, 1994.

[51] Int. Cl.[6] ..... H01J 61/067

[52] U.S. Cl. ..... 313/346 DC; 445/51; 445/59; 313/491

[58] Field of Search ..... 445/50, 51, 59; 313/346 R, 346 DC

[56] References Cited

U.S. PATENT DOCUMENTS

| | | | |
|---|---|---|---|
| 3,766,423 | 10/1973 | Menelly | 313/346 R X |
| 3,969,279 | 7/1976 | Kern | 313/346 R X |
| 4,279,784 | 7/1981 | Misumi et al. | 313/346 R X |
| 4,303,848 | 12/1981 | Shimizu et al. | 313/346 R |
| 4,404,492 | 9/1983 | Palty | 313/346 R X |
| 4,748,493 | 5/1988 | Geenen et al. | 357/68 |
| 4,822,312 | 4/1989 | Passmore | 445/49 |
| 5,015,908 | 5/1991 | Miram et al. | 313/346 R X |
| 5,138,224 | 8/1992 | Goldburt et al. | 313/346 R X |

*Primary Examiner*—Kenneth J. Ramsey
*Attorney, Agent, or Firm*—Ernestine C. Bartlett

[57] ABSTRACT

Lamps that include composite sintered electrodes with improved properties that make them suitable for use in a variety of lamp types, are provided by a method for producing electrodes which comprise a refractory metal and a refractory emitter oxide, either single layer or multiple layer, the composites having been subjected to sintering at an elevated temperature effective to form a composite electrode having a density of at least 85%, preferably in the presence of a sintering activator, such as for example, Ni, or mixture thereof with a sintering aid such as, for example $Li_2O$.

37 Claims, 6 Drawing Sheets

MULTIPLE LAYER COMPOSITE ELECTRODES FOR DISCHARGE LAMPS AND LOW TEMPERATURE CO-SINTERING METHOD FOR PRODUCING THE SAME

CROSS-REFERENCE TO RELATED APPLICATIONS

This is a division of application Ser. No. 08/363,184, filed Dec. 23, 1994. The present application is related to the following applications; (1) "Refractory Oxides As Electrodes For HID Lamps" of Hui-Meng Chow and Vivek Mehrotra, Ser. No. 08/938,483 filed Sep. 30, 1997, which is a continuation of Ser. No. 08/611,311 filed Mar. 5, 1996, now abandoned, which in turn is a continuation of Ser. No. 363, 183 filed Dec. 23, 1994, now abandoned; (2) "New Emission Materials For Discharge Lamps and Method For Manufacturing Electrode Structures With Such Materials" of Vivek Mehrotra, Hemant S. Betrabet, David R. Woodward, Thomas O. Leyh, and Susan McGee, Ser. No. 08/916,747 filed Aug. 19, 1997, now U.S. Pat. No. 5,744, 905, which is a continuation of Ser. No. 08/759,509 filed Dec. 4, 1996, now abandoned, which in turn is a continuation of Ser. No. 08/363,182 filed Dec. 23, 1994, now abandoned; and (3) "An Electrode Structure For Discharge Lamp, Welding Apparatus For Use In Making An Electrode Structure and Method of Welding" of Thomas McGee and Vivek Mehrotra, Ser. No. 08/363,177 filed Dec. 23, 1994, now abandoned.

FIELD OF THE INVENTION

This invention relates to electrodes for discharge lamps and more particularly to sintered composite electrodes for discharge lamps, preferably low pressure fluorescent lamps and to a low temperature method of producing such electrodes.

BACKGROUND OF THE INVENTION

The principal requirements for instant start, low-pressure discharge lamp composite electrodes based on mixtures of tungsten and oxide emitters are: (i) low work function, (ii) low thermal conductivity, (iii) low electrical resistivity, (iv) good mechanical properties, (v) high melting point, and (vi) low vapor pressure.

These requirements often conflict with each other in terms of material properties, i.e. each of the above requirements may be individually realized, but all six are difficult to realize in one electrode. For example, tungsten as an electrode material has many favorable properties. It has a high melting point, low vapor pressure, low electrical resistivity and is chemically stable in a lamp environment. However, it has a high work function and high thermal conductivity. Barium oxide on tungsten surface has a low work function. The attainment of low thermal conductivity requires a high volume fraction of the oxide emitter whereas good mechanical strength and low electrical resistivity allowing weldability to the feedthrough requires a low volume fraction of the oxide. One solution to the problem of simultaneously meeting the geometrical and physical requirements is to design and fabricate composites of metal and ceramic to make a composite electrode with multiple layers in such a way that every layer serves a function. However, to date, each requirement has been best met in a narrow optimum range of compositions and these optimum ranges have been different for different requirements.

According to the present invention, novel multiple layer composite electrodes may be provided, using simple powder technology, which meet all of the requirements for use in a variety of lamp types including narrow diameter (ND) fluorescent lamps and which offer versatility in achieving one or more of the four requirements listed above. Such a multiple layer electrode is schematically shown in FIG. 1 and may consist of two or more layers.

Layered electrodes have been proposed by workers in the art. For example:

U.S. Pat. No. 3,244,929 discloses layered electrodes that are said to achieve zones of different vaporization and work function. In this construction, the bottom layer has a lower metal content than the top layer, an arrangement that is opposite to that utilized in the electrodes of this invention wherein a proper balance between thermal conductivity, electrical conductivity, and feedthrough attachment is attained; additionally, different emission compounds are utilized, the feedthrough -electrode geometry is completely different, and sintering temperatures are used that are unsuitable for use herein as will be described further hereinbelow;

U.S. Pat. Nos. 4,881,009 and 4,822,312 disclose layered electrodes to achieve a gradient in the thermal expansion coefficient, the top layer is pure tungsten and the layers thereafter are mixtures of tungsten and aluminum oxide. No emitter materials are disclosed;

JP-A 1-63253 and JP-A 1-63254 disclose layers made of semiconducting ceramic . The objective of this patent is to increase the resistivity of the top layer to shorten the time to transition for sustaining an arc discharge. The semiconductor ceramic has a low thermal conductivity but the electrical conductivity is low thereby increasing the electrode losses. EP 584858 discloses electrodes having a uniform density, i.e. layered electrode are not disclosed. The feedthrough cannot be welded by contact welding because of the poor weld and breakage of the sintered electrode. Additionally, emitter materials are used which are moisture sensitive and cannot be used by simple powder mixing. Sintering temperatures are incompatible with the emitter materials used herein , and the use of expensive alkoxide materials is required.

Various publications have also dealt with tungsten electrodes and the sintering of tungsten. For example: U.S. Pat. No. 3,798,492 discloses an electrode structure comprising a fused mixture of a principal amount of a refractory metal and a smaller amount of an electron emissive material is made by melting at least one of the powders;

U.S. Pat. No. 4,748,493 discloses diodes with metal studs that are sintered bodies containing tungsten, a sintering activator such as nickel, and an oxidic sintering aid such as $Y_2O_3$. Studs formed in the absence of the sintering aid are said to be unduly coarse which leads to a reduction of the mechanical strength of the metal studs;

JP A 55-123135, JP A 59-75554, and JP A 58-75862 disclose lamp components having a mixture of tungsten and fine powders of Ni, Fe, and Co;

JP A 59-755554 discloses addition of fine powders of Ni, Fe, and Co to a sintered tungsten coil coated with an electron radiating material comprising barium;

German et al, "Systematic Trends in the Chemically Activated Sintering of Tungsten", *High Temperature Science,* 8, pp. 267–280 (1976) discloses the addition of transition metals Ni, Pt, Pd, Rh and Co as sintering activators to reduce sintering temperatures and increase densification of tungsten;

DE 756,326 discloses composite electrodes of tungsten powder and unspecified barium compounds;

DE 1021482 discloses the manufacture of "oxide cathodes" having a core which is coated with an earth alkaline carbonate mixture, the carbonate is converted into oxide by heating, and oxides such as $TiO_2$ are added to the mixture although having a negative influence on the electron emission because they aid in the formation of oxides; and Hennings et al, "Control of Liquid Phase Enhanced Discontinuous Grain Growth in Barium Titanate", *J. Am. Ceram, Soc.,* 70,[1], pp 23–27 (1987) discloses that $TiO_2$ can accelerate the sintering of $BaTiO_3$.

The fabrication of composite electrodes via powder technology involves three main stages. These are (i) component powder mixing and blending, (ii) powder compacting, and (iii) co-sintering. The initial problems in fabricating the composite electrodes of the invention were related to the co-sintering of tungsten and the emitter oxides such as Ba mixed oxides. As mentioned above, tungsten has a high work function and high thermal conductivity. Barium has been found to lower the work function of tungsten by forming a monolayer on its surface. However, BaO as well as CaO and SrO powder cannot be used directly in many applications because of their highly hygroscopic nature. Similarly, barium carbonate cannot be used since BaO would form at the sintering temperature and pose problems during machining and exposure to the atmosphere. It will also react with tungsten to form barium tungstates, which have a high work function. In order to avoid these problems, mixed oxides of BaO have been used. These mixed oxides are not hygroscopic. We have found that the liquation of a Ba-mixed oxide phase $BaTiO_3$ occurs when the composite is sintered at the temperature where W starts to densify. We have also found that merely lowering the sintering temperature to a level below the melting point of the $BaTiO_3$ phase does not solve the problem since in this case neither W nor the oxide phase densifies. When $BaZrO_3$ is used, it is possible to co-sinter the composite at a high temperature (2000° C.) without the liquation of $BaZrO_3$ since it has a high melting point. However, in this case the high temperature sintering results in the depletion of BaO from the surface of the electrode. Consequently, the surface has a high work function and does not emit. Other problems related to the emitter oxide must also be overcome. Thus, when mixtures of W and Ba mixed oxide powders are blended without additives and co-sintered at temperatures at which W densifies (>1800° C.), any of the following types of degradation of the mixed oxide, in particular barium zirconate, occur: 1) thermal decomposition of the barium based mixed oxide because of its incompatibility with the high sintering temperatures required for tungsten; (2) chemical reaction of the liberated barium oxide with tungsten. The consequence of (1) and (2) is that free Ba or BaO is liberated during electrode fabrication and therefore reduced amounts of Ba and BaO are available during electrode operation; and (3) Liquation of barium mixed oxide, and particularly barium titanate, at the temperature at which tungsten densifies. Liquation can cause formation of localized cracks and voids, substantial coarsening of the Ba mixed oxide phase, results in tungsten being encapsulated by Ba mixed oxide so that a network of W is not formed. This results in electrodes with inhomogeneous distribution of the emitter at the surface. Consequently, the electrode can have regions of pure tungsten with high work function. Moreover, the liquid oxide phase can form an interconnecting network which prevents the formation of an interconnecting tungsten network. Such an electrode will exhibit poor mechanical properties and high electrical resistivity, since intergranular fracture could easily occur by crack propagation through the brittle, interconnected ceramic phase. Handling and welding of such electrodes to feedthroughs also poses a serious problem. To date, no single solution to the above problems has been found that permits tailoring an electrode to meet a significant number and preferably all of the desired requirements.

SUMMARY OF THE INVENTION

An object of this invention is to provide novel multiple layer composite electrodes that meet all of the requirements set forth hereinabove.

Another object of the invention is to provide novel multiple layer composite electrodes that are suitable for use in low pressure discharge lamps.

A further object of the invention is to provide novel multilayer electrodes that may be tailored to provide the characteristics needed, as desired, that are suitable for use in a wide variety of lamp types including high intensity discharge lamps as well as narrow diameter fluorescent lamps and that may be produced via powder technology.

Yet another object of the invention is to provide a method using such powder technology to produce such multilayer composite electrodes.

Still another object is to provide such a method in which pressed multilayer powder bodies are subjected to a low temperature co-sintering method without the degradation outlined above and with increased homogeneity and improved mechanical properties. This method comprises the use of activated sintering for the tungsten phase and sintering aids for the emitter oxide phase of the composite bodies to form dense composite electrodes, at least in one layer of the multilayer composite. This method also comprises the formation of such multilayered composites wherein the activated sintering of tungsten phase and addition of sintering aids for the emitter oxide phase may be included in certain layers and eliminated in other layers of the multilayer composite electrode of the invention in order to incorporate a certain amount of porosity for lowering the overall thermal conductivity of the electrode.

Another object of the invention is to provide novel multilayer composite electrodes which have different volume fractions of oxide emitter powder and wherein at least one of the layers has a low oxide content that permits welding to the feedthrough.

These and other objects of the invention will be apparent in view of the description of the invention which follows.

In accordance with the invention, composite electrodes of a refractory metal and a refractory emitter oxide are provided. Preferably such electrodes are multiple layered composite electrodes comprising layers of a mixture of refractory metal and refractory emitter oxide in which the layers have different volume fractions of emitter oxide and/or in which the layers include emitter oxides or mixtures thereof. In preferred embodiments of the invention, the composite electrodes are sintered via a low temperature co-sintering procedure and contain an effective amount of a Group VIIIa transition metal such as Ni, as an activator for the refractory metal, with preferably an effective amount of a Group Ia alkali metal compound such as $Li_2O$, or a metal oxide such as $TiO_2$ as a sintering aid for the emitter oxide phase. The electrodes are versatile, may be tailored to meet a variety of requirements, and can be readily subjected to a variety of mechanical operations. For example, in one embodiment, the composite electrode will have at least one layer that has a low oxide content and at least one layer that has a high oxide content whereby the composites may be machined into electrodes and welded to feedthrough wires via conventional contact welding such as resistance spot welding.

The multiple layer composite electrodes may be provided by a method which comprises the steps of:

(a) mixing a refractory metal powder such as tungsten with different amounts of an oxide emitter powder;

(b) depositing a first refractory metal powder/oxide emitter powder mixture, preferably by pouring, into a die to form a base layer;

(c) depositing at least a second refractory metal powder/oxide emitter powder mixture, preferably by pouring, into the die to form a top layer adjacent to the base layer after which additional layers are sequentially deposited, as desired, to form a top layer adjacent to an underlying layer;

(d) preferably, tapping or otherwise moving the die after each deposit of a refractory metal/emitter oxide mixture to assure a reasonably flat surface of said top layer;

(e) pressing the deposited layers to form a multilayered body; and (f) sintering the said multilayered body at an elevated temperature effective to form a multilayered composite electrode having a density of at least about 85%, said elevated temperature being selected from the range of (i) a temperature at least above the temperature at which sintering of the refractory metal with activator is initiated and the composite density of at least 85% is achieved and (ii) a temperature below the temperature at which (x) sintering of the refractory metal without activator is initiated and (y) the emitter oxide and/or activator undergo substantial degradation. (As used herein, the term "degradation" includes melting of the activator metal, densification of the emitter oxide beyond the extent desired for balanced properties and for obtaining the desired tungsten density, depletion of BaO from the surface of the body during sintering, and other undesirable occurrence that negatively affects the ability of the either the metal or emitter oxide or both to function as desired to achieve the results of the invention.

Preferably, when the metal is tungsten and the activator is Ni, said temperature will be within the range of about 1100° C. to about 1400° C. and will be about 1300° C. in the most preferred embodiments.

Any of a variety of oxide emitter materials may be satisfactorily utilized in the practice of the invention such as $Ba_3Y_4O_9$, $BaY_2O_4$, $BaCeO_3$, $Ba_{0.5}Sr_{0.5}Y_2O_4$, $Ba_4CaAl_2O_4$, $Ba_{0.5}Sr_{0.5}Y_2O_4$, $BaSc_4O_9$, $Ba_2TiO_4$, $Ba_4Ta_2O_9$, $Ba_{0.5}Sr_{0.5}TiO_3$, $BaLa_2O_4$, $BaZrO_3$, $BaAl_2O_4$, $BaTiO_3$, $Ba_5Ta_4O_{15}$, $BaTiO_3$, $Ba_{0.33}Sr_{0.33}Ca_{0.33}TiO_3$, $BaSiO_3$, $Ba_{0.5}Sr_{0.5}ZrO_3$, $BaTa_2O_6$, etc. Especially preferred are $BaZrO_3$, $BaTiO_3$, and $Ba_xStr_{l-x}TiO_3$, $Ba_xSr_{l-x}ZrO_3$, and $Ba_4Ta_2O_9$ oxides wherein x is 1 to 0, and is preferably 0.5.

In accordance with the present invention, the multilayered body described in step (e) above is subjected to a low temperature co-sintering method in the presence of certain sintering activators and/or additives. Low temperature (about 1100° to 1400° C. depending on the activator, the metal, etc.) cosintering of the composites prevents the degradation of the oxide emitter observed at high temperatures and comprises the activated sintering of the metal such as W with an effective amount of a Group VIIIa metal such as Ni, and the sintering of the oxide phase with an effective amount of a sintering aid such as $Li_2O$ or $TiO_2$ depending upon the particular oxide emitter.

Metals that are suitable for use as activator additives according to the invention are Group VIIIa transition metals such as Ni, Pt, Pd, Rh, Ru, Fe, Co and Cu, and preferably is Ni, which acts as an activator for the refractory metal during sintering. Suitable sintering aids or activator additives for the mixed oxide phase when the oxide is $BaTiO_3$ include at least one other oxide such as $TiO_2$ which leads to liquid phase sintering of the oxide phase in the composite. Other liquid phase sintering aids for the mixed oxides such as LiF, LiH and $Li_2O$ may also be used. Preferably, the sintering aid is an effective amount of $TiO_2$ when the oxide is $BaTiO_3$ and an effective amount of $Li_2O$ when the oxide is $BaZrO_3$ or $Ba_xSr_{l-x}ZrO_3$. The additives or sintering aids may or may not be used in a specific layer of a composite. In preferred embodiments such as the multilayered illustrated further in Example 4, Ni is not used as an activator for W sintering in the top layer, but is used in the bottom layer. This results in a controlled amount of porosity in the top layer so that the thermal conductivity of the two-layer composite is significantly reduced. The bottom layer still densifies due to the presence of Ni and $LiO_2$ as sintering aids and this enables resistance welding of electrodes to feedthrough wires.

Amounts of activator additives may vary as necessary to achieve the desired results. It has been found that an amount of nickel of about 0.2 wt. % of the amount of tungsten is effective, the critical amount apparently being that amount that is necessary to form a monolayer on tungsten of a given particle size. Excessive amounts of nickel retard the activated sintering process and are to be avoided. Similarly, an effective amount of $TiO_2$ has been found to be about 2–3 mol. % of the amount of the $BaTiO_3$ while an effective amount of $Li_2O$ is about 2–3 mol. % of the amount of $BaZrO_3$ or $Ba_xSr_{l-x}ZrO_3$.

While even single layer composite bodies may be vastly improved if subjected to the low temperature co-sintering process of the invention, the same is essential to the production of the multilayer composite electrodes as illustrated further hereinbelow. A method as described results in dense composites which have sufficient mechanical properties to be machined into small electrodes and to be resistance-welded to feedthrough wires. The electrode-feedthrough assemblies can be used in an axial configuration in narrow diameter fluorescent lamps or other instant-start low pressure lamps such as TL and compact fluorescent lamps. One such use of the electrodes is described and claimed in co-pending application Ser. No. 08/581,236 and 08/581,237 of Vivek Mehrotra, Thomas McGee, Susan McGee, Jeoren Langevoort and Edward Young titled "New Electrodes For Narrow Diameter Fluorescent and Neon Lamps"both filed Dec. 29, 1995. The electrodes can also be used in high intensity discharge and neon lamps.

As indicated hereinabove, the novel multilayer composite electrodes of the invention are manufactured according to a method in which a refractory metal such as tungsten is mixed with different volume fractions of an oxide emitter powder such as barium zirconate, barium titanate, barium strontium zirconate, etc., the powders are sequentially poured into a die, pressed, sintered into solid bodies and fabricated into electrodes by machining.

Alternatively, the powders may be ground using a mortar and pestle and in a vibratory mill such as a Spex mill in a vessel having a convoluted nickel wire. As will be seen below, merely mixing the powders by simple blending leads to inhomogeneous distribution of tungsten and oxide. A more homogeneous distribution can be achieved by vibratory mill and is desirable.

Preferably, the electrode after sintering is then resistance welded to feedthrough wires using the procedure disclosed and claimed in copending application Docket No. 1504-0801, referred to hereinabove.

The resulting electrode is optimized in properties and exhibits a proper balance between low electrical resistivity, low thermal conductivity, and sufficient mechanical properties to permit the attachment of the feedthrough wire. Moreover, emission testing of the emitters used in the electrodes of the invention indicate a good thermionic behavior.

DETAILED DESCRIPTION OF PREFERRED EMBODIMENTS

EXAMPLE 1

Figure 1A:
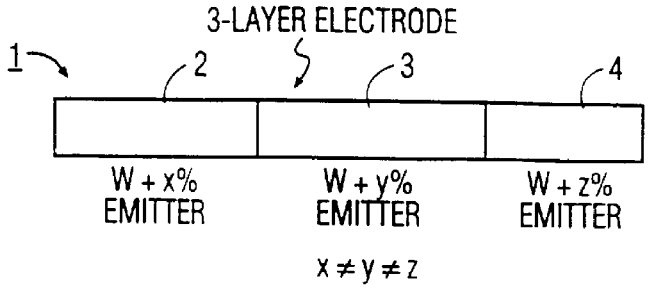
FIGS. 1*a,* 1*b,* 1*c,* and 1*d* are schematic illustrations of a multiple layer electrode produced according to the invention.
Figure 1B:
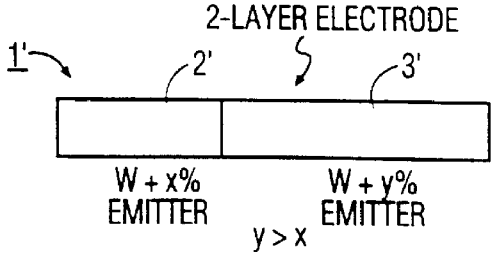
Figure 1C:
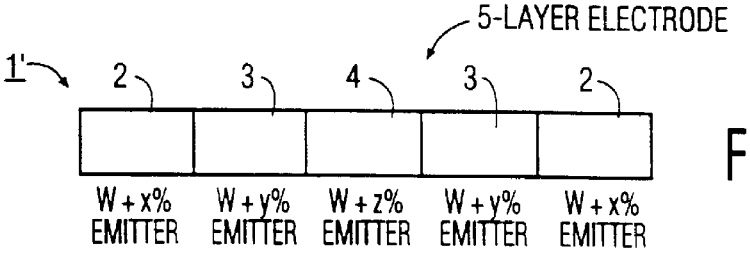
Figure 1D:
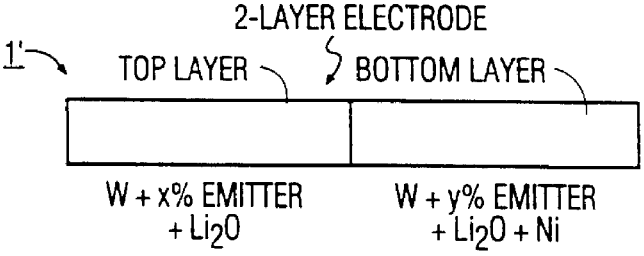
Figure 2A:
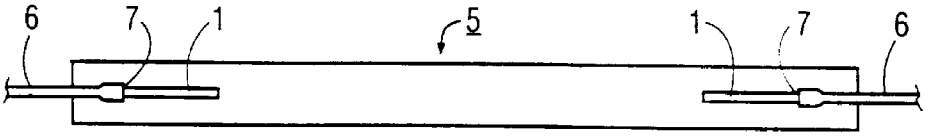
FIGS. 2*a* and 2*b* are schematic illustrations of an electrode-lead wire assembly provided in an axial geometry useful in narrow diameter fluorescent lamps and other TL fluorescent lamps and having an electrode according to this invention.
Figure 2B:
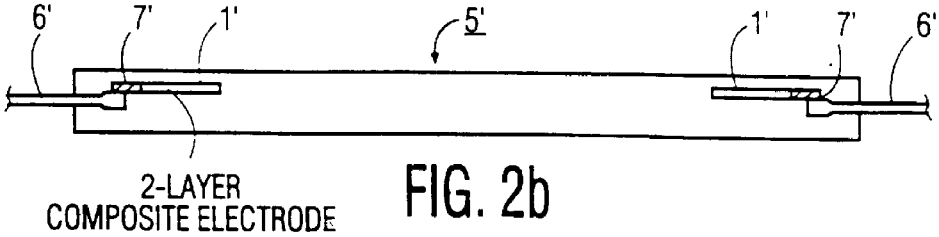
Figure 3A:
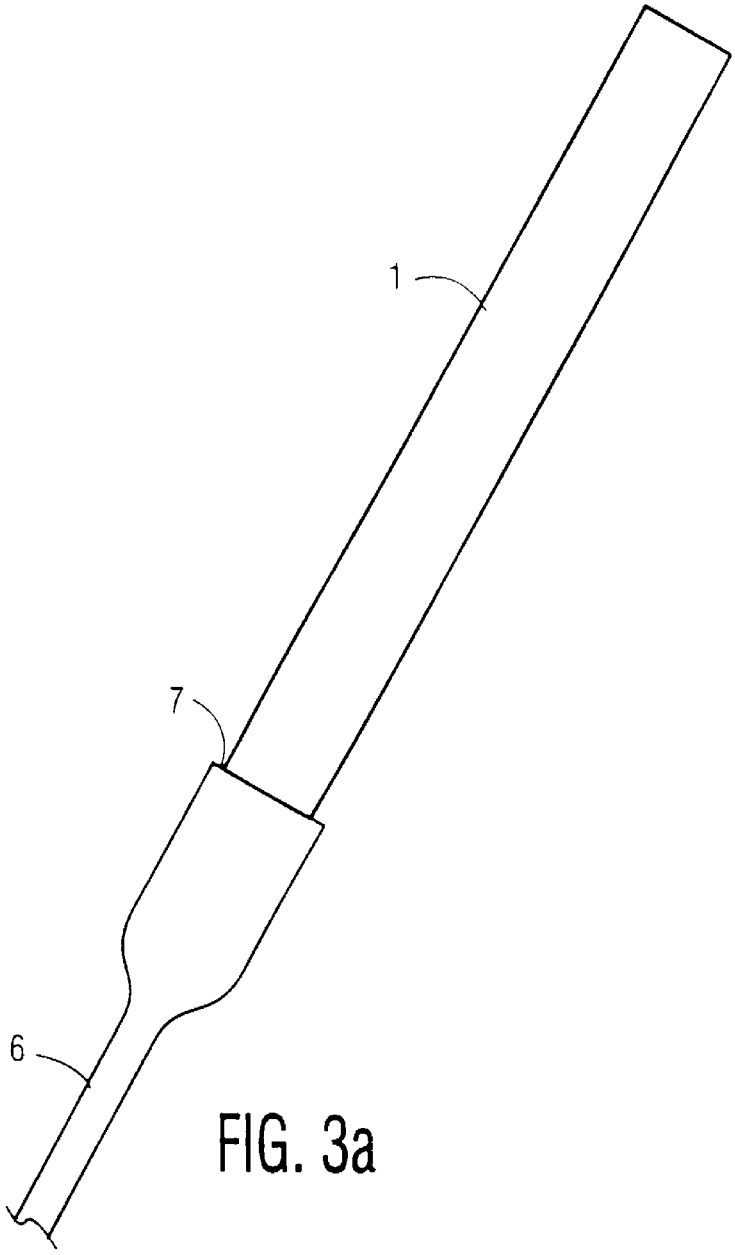
FIG. 3*a* is a schematic illustration of a butt welded composite electrode and feed through wire structure having an electrode according to the invention and FIG. 3*b* illustrates a lap welded composite electrode and feedthrough wire structure having an electrode according to the invention.
Figure 3B:
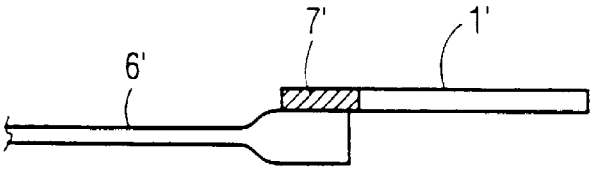

With reference to FIG. 1, Tungsten (W) powder was first mixed with different volume fractions of barium zirconate or barium titanate or barium strontium zirconate. The sintering aids Ni, $Li_2O$, and/or $TiO_2$ were added as and when desired. The powders were sequentially poured into a die and lightly tapped after each pouring to yield a relatively flat surface. After pressing, the multiple layers could be observed in the green pellets. The pellets were then sintered into solid bodies using the sintering procedure of heating at about 1300° C. for about 2–4 hours, and electrodes of the required dimensions were then fabricated. Such a multiple layer electrode is shown schematically in FIG. 1*a* wherein W is tungsten, and x, y, and z represent the oxide emitter content of the various layers and $x \neq y \neq z$. FIG. 1*b* also shows a two-layer composite electrode wherein W is tungsten, and x and y represent the emitter oxide content and $y>x$. The upper layer is represented by y% emitter and the lower layer is represented by x% emitter. Feedthrough wire is attached to the lower layer and the upper layer faces the discharge in the lamp. Optical microscopy on polished electrodes revealed sharp interfaces between different layers containing different volume fractions of the oxide emitter. The electrodes were 0.5 mm×0.5 mm in cross-sectional area and individual layer thicknesses were relatively uniform from one electrode to the other. The thickness of each layer may vary as desired and can be controlled by the amount of powder used during pressing. With reference to FIGS. 2 and 3, such electrodes may then be resistance welded to the feedthrough wires as illustrated, for example a lamp 5,5' which comprises a composite electrode 1,1' a composite electrode 1 of the invention, which may consist of layers 2,2', 3,3', or 4, and which may have a diameter of less than about 0.8 millimeters, is butt welded to a nickel coated iron feedthrough wire 6 via a metallurgical bond 7. Alternatively, a 2-layer composite electrode 1' with cross-sectional area of 0.5mm×0.5 mm may be lap welded to a nickel coated iron feedthrough wire 6' via a metallurgical bond 7'.

EXAMPLE 2

Several multilayer electrodes were produced using the procedure of Example 1 with Ni and $Li_2O$ sintering aids as desired. Thermal conductivity measurements were performed on two, three and five layer pellets. The three and five layer electrodes are designed to cause a gradual change in the composition of the electrode.

A. A three layer composite electrode as illustrated in FIG. 1 and consisting of a layer 1 comprising about 2.05 mm of W+40 vol. % $BaZrO_3$ , a layer 2 comprising about 2.54 mm of W+75 vol. % $BaZrO_3$, and a layer 3 comprising about 1.89 mm of W+40 vol. % $BaZrO_3$, respectively, had a thermal conductivity of about 14 W/m-K. This value is well within the requirement of low thermal conductivity. Resistance welding was used to weld one of the 40 vol. % oxide sides of the electrode to the feedthrough wire.

B. A five-layer composite electrode consisting of about 2.75 mm W+40 vol. % $BaZrO_3$/1.72 mm W+62 vol. % $BaZrO_3$/2.90 mm W+75 vol. % $BaZrO_3$/1.63 mm W+62 vol. % $BaZrO_3$/1.77 mm W+40 vol. % $BaZrO_3$ respectively, had a thermal conductivity of about 16 W/m-K. Again, a resistance weld was made to the feedthrough wire at one of the low oxide sides. The intermediate layers may serve to lower the heat conduction during operation and may act as a reservoir of BaO during extended lamp operation.

EXAMPLE 3

Several multilayer electrodes were produced using the procedure of Example 1. Two-layer composite electrodes were prepared with about 1.66 mm W+40 vol. % $BaZrO_3$/4.69 mm W+75 vol. % $BaZrO_3$ The sintering aids used were Ni and $Li_2O$. The thermal conductivity was measured to be about 11.2 W/m-K.

EXAMPLE 4

The following two-layer composite electrodes were prepared using the procedure of Example 1:

Electrode 1 a. Top layer: 75 vol. %$Ba_{0.5}Sr_{0.5}ZrO_3$+25 vol. % W. 3 mol % $Li_2O$ based on the amount of the $Ba_{0.5}Sr_{0.5}ZrO_3$ was added as a sintering aid. No Ni was added in the top layer.

b. Bottom layer: 40 vol. % $BaO_{0.5}Sr_{0.5}ZrO_3$+60 vol. % W. 3 mol % $Li_2O$ based on the amount of $Ba_{0.5}Sr_{0.5}ZrO_3$ was added as a sintering aid and 0.2 wt. % Ni based on the amount of tungsten was added as a sintering aid.

An electrode was produced which has a controlled amount of porosity which is high enough to yield low thermal but high electrical conductivity and also has satisfactory mechanical strength. The amount of oxide used in the top layer and the amount of porosity incorporated balanced the low thermal conductivity with high electrical conductivity. The density of the top layer of the electrode was measured to be about 87% of theoretical density. The bottom layer of the electrode was highly dense and had a higher metallic content. This allowed feedthrough attachment via resistance welding. The bottom layer of the electrode was about 2–3 mm in length and the top layer was about 4–5 mm in length. The electrode had a square cross section of 0.4–0.5 mm and a thermal conductivity of about 5.9 W/m-K.

Electrode 2 a. Top layer: 50 vol. % $BaTiO_3$+30 vol. % $Ba_2TiO_4$+20 vol. % W. 0.2 wt. % Ni based on the amount of tungsten and 3 mol% $TiO_2$ based on the amount of $BaTiO_3$ were added as sintering aids.

b. Bottom layer: 30 vol. % $BaTiO_3$+10 vol. % $Ba_2TiO_4$+60 vol. % W. 0.2 wt. % Ni of the amount of tungsten and 3 mol% $Tio_2$ of the amount of $BaTiO_3$ were added as sintering aids.

The electrodes described as Electrode 1 were etched for 2 minutes in hot peroxide solution, maintained at 70° C., to remove the tungsten from the 20–40 $\mu$m surface layers. The electrodes were dipped into hydrogen peroxide in such a way as to remove tungsten from the top layer without affecting the bottom layer.

The electrodes described as Electrode 2 were also etched for 5 minutes in hot 30% hydrogen peroxide solution, maintained at 70° C., to remove tungsten from the top surface layers. Removal of tungsten is essential to prevent any end-blackening of the glass walls during lamp operation.

EXAMPLE 5

Figure 4A:
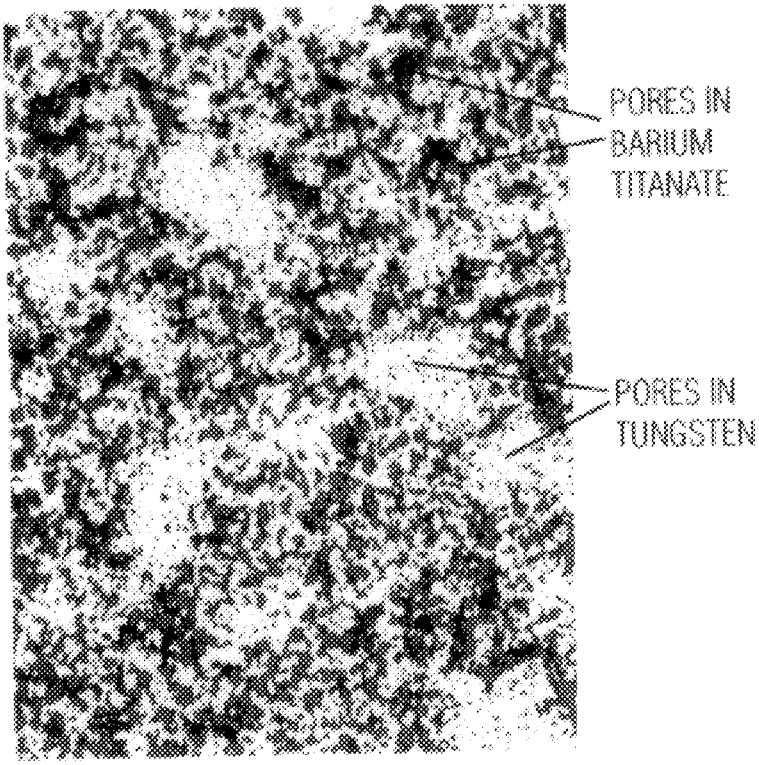
FIG. 4*a* is an optical micrographic cross-sectional view of W+$BaTiO_3$ after sintering (at 650X magnification)

A. To further illustrate the co-sintering method of the invention, tungsten powder(1.4 $\mu$m) was blended with 40 volume % $BaTiO_3$ powder (1 $\mu$m) and pressed into pellets at 300 ksi. The cosintering of W and $BaTiO_3$ in the form of pellets at 1300° C. for 2 hours in 5% $H_2$-He resulted in a 80% dense composite. A microstructure illustrating the density of this composite is illustrated in FIG. 4*a*. A large amount of porosity is present both in the W phase and in the $BaTiO_3$ phase.

Figure 4B:
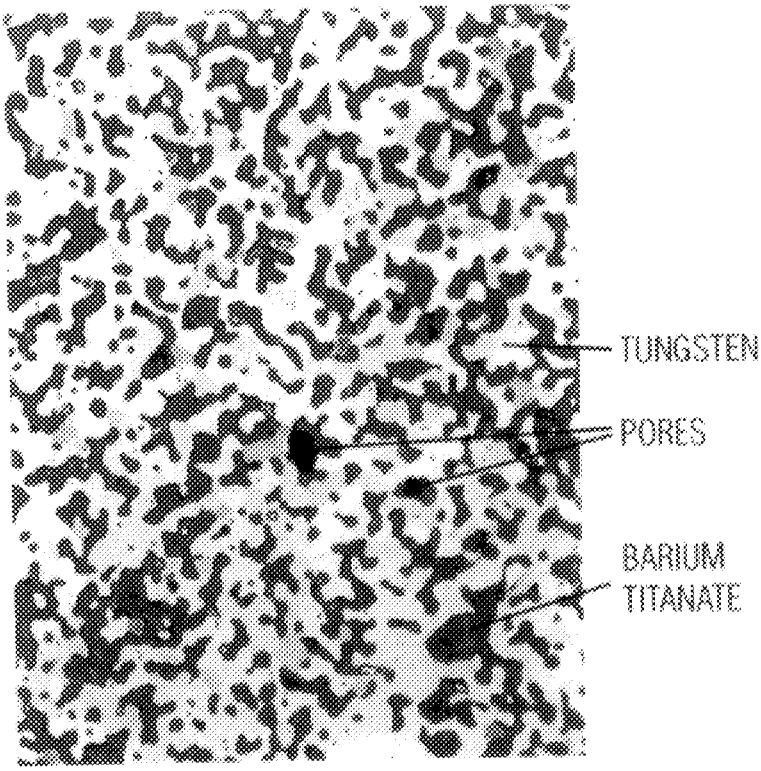
FIG. 4*b* is an optical micrographic cross-sectional view of W+$BaTiO_3$+$TiO_2$+Ni after sintering (at 650X magnification)

B. The procedure of Part A above was repeated except that 0.2 wt % of fine Ni powder (325 mesh) was blended with the tungsten powder and this mixture was then blended with the $BaTiO_3$. This resulted in a 96% dense composite after pressing and sintering. This experiment was repeated except that 2 mol % $TiO_2$ was added to the mixed oxide and this mixture was blended with the W-Ni mixture, pressed and sintered. This resulted in a 98% dense composite. Further improvements in density can be achieved by increasing the sintering time. A microstructure of the W+40 vol. %$BaTiO_3$+$TiO_2$+Ni composite after sintering is illustrated in FIG. 4*b*. There is considerably less porosity in the composite of the invention compared to that of the structure illustrated in FIG. 4*a*. Furthermore, when comparing the morphologies of the W phase, it is evident that the lack of pores in the W phase in FIG. 4*b* leads to greater interconnectivity which permits feedthrough attachment via resistance welding.

Figure 5:
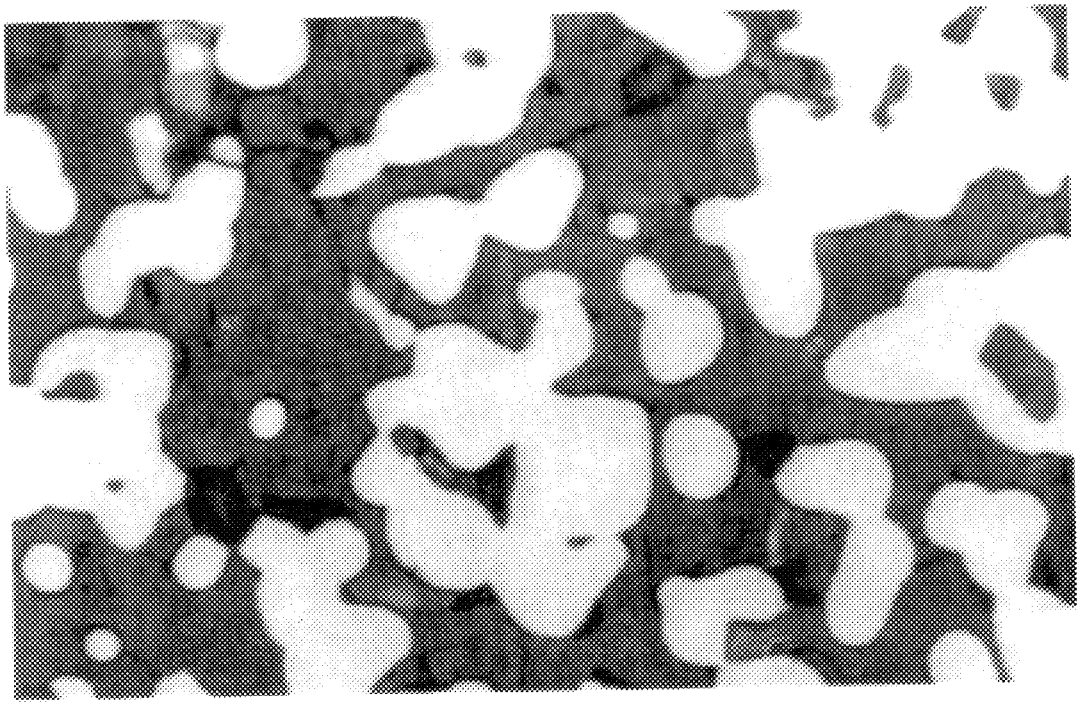
FIG. 5 is an optical micrographic cross-sectional view of W+$BaTiO_3$ sintered at 1800° C. and illustrates liquation (at 1300X magnification)
Figure 6:
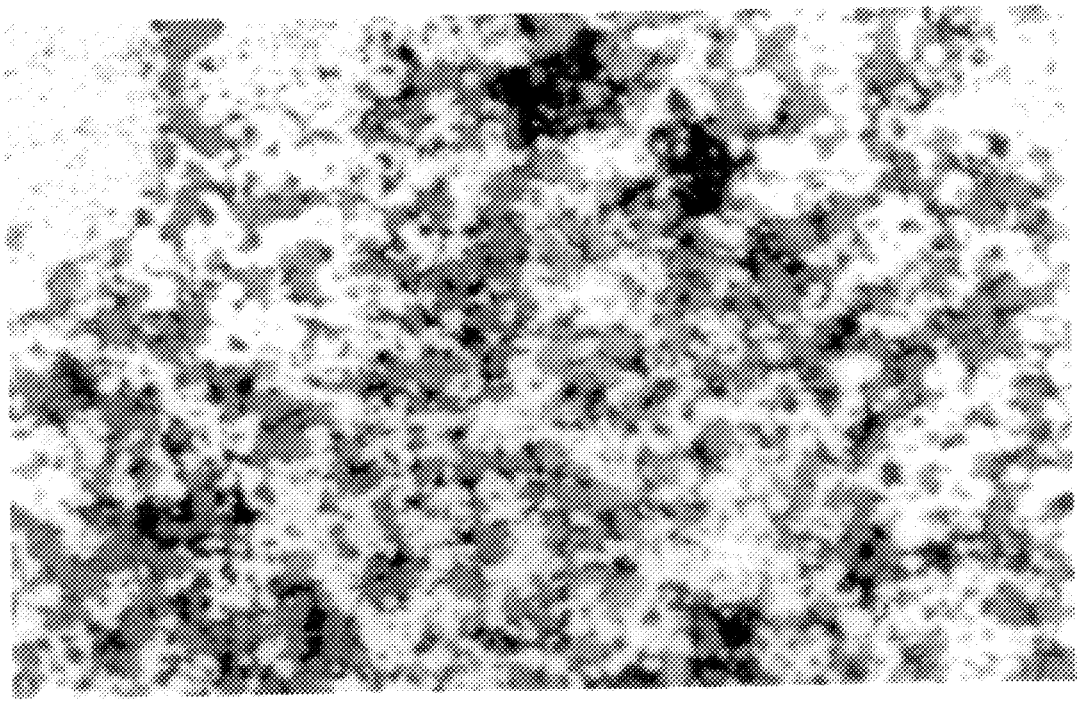
FIG. 6 is an optical micrographic cross-sectional view of the same W+$BaTiO_3$ without any additives sintered at 1300° C. and illustrates the effect of merely lowering the sintering temperature (at 1300X magnification)
Figure 7:
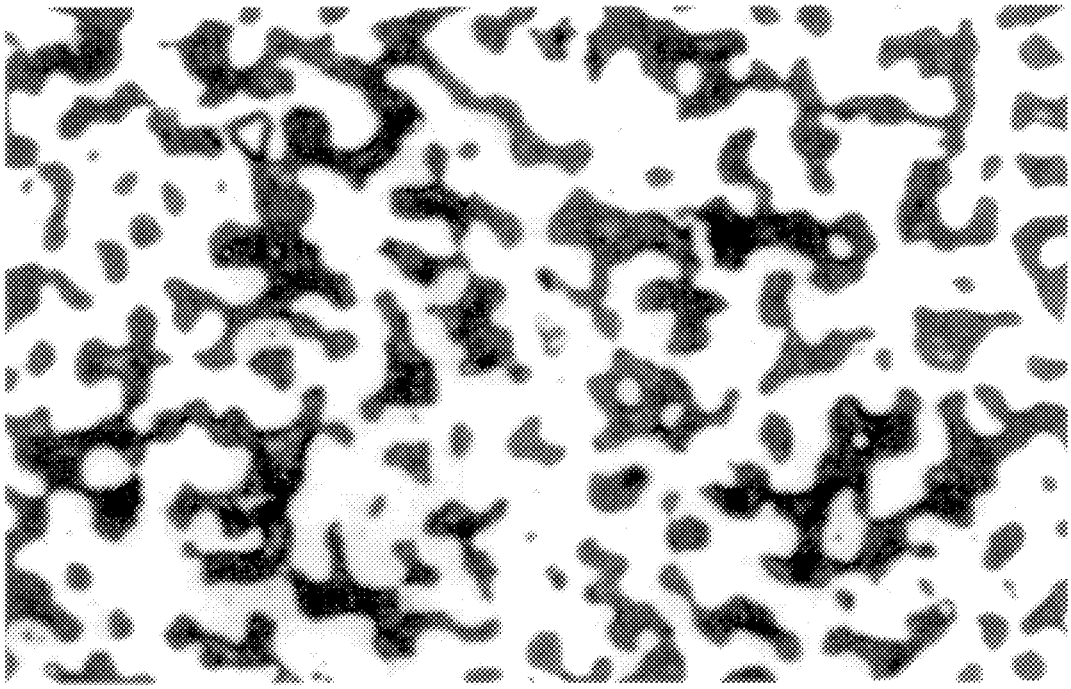
FIG. 7 is an optical micrographic cross-sectional view of W+$BaTiO_3$+Ni+$TiO_2$ sintered at 1300° C. and illustrates an embodiment of the invention(at 1300X magnification)
Figure 8:
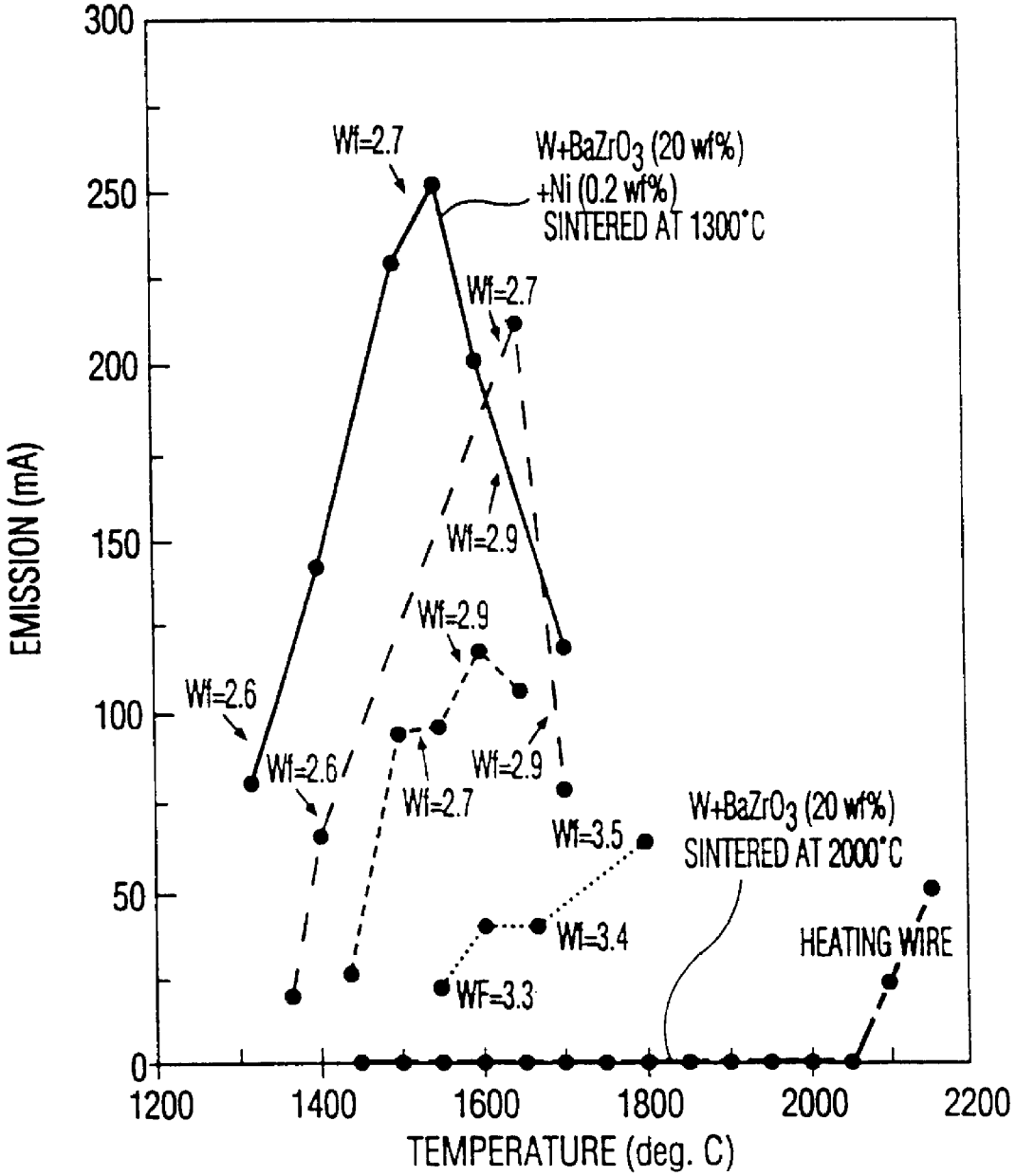
FIG. 8 is a graph illustrating the emission of W+$BaZrO_3$ sintered at 2000° C. and of W+$BaZrO_3$+Ni sintered at 1300° C.

C. With reference to FIGS. 5–8, the procedure of Part A above was repeated except for the variables noted below. The results were as illustrated in the figures. FIG. 5 illustrates that liquation occurs when a composite of W+40 vol. %$BaTiO_3$ is sintered at 1800° C. Cracks and voids in the $BaTiO_3$ phase are visible and it would be very difficult to butt or lap weld such electrodes to feedthroughs because of poor mechanical strength. When the same composition is sintered at 1300° C., neither W nor the oxide phase densifies. (See FIG. 6). When Ni and $TiO_2$ are added as sintering aids, as illustrated in FIG. 7, the W phase is interconnected and excellent mechanical properties are obtained, and the electrode may be butt or lap welded. When the procedure is repeated with W+40 vol. % $BaZrO_3$, and sintered at temperatures within the range of about 1800°–2000° C., liquation does not occur because $BaZrO_3$ has a high melting point. However, in this example, the high temperature sintering results in the depletion of BaO from the surface of the electrode. Consequently the electrode has a high work function and does not emit as illustrated in FIG. 8. However, when Ni is added and the same composition is sintered at 1300° C., the desired properties and excellent electron emission is obtained. In multilayered electrodes containing a large volume fraction of $BaZrO_3$ in the top layer, a large amount of BaO was lost when sintered at 1800°–2000° C. The procedure of adding sintering aids to the tungsten and oxide phases is most preferably always used at least for the bottom layer of the layered composite electrode, where the feedthrough is attached. The sintering aids may be eliminated, if desired, from the other layers in order to incorporate certain porosity to lower the effective thermal conductivity of the electrode.

The invention may be embodied in other specific forms without departing from the spirit and scope or essential characteristics thereof, the present disclosed examples being only preferred embodiments thereof.

We claim:

1. A method for producing a multiple layered composite electrode which comprises the steps of:

(a) mixing a refractory metal powder with different volumes of an oxide emitter powder selected from the group consisting of (a) single layer composites of a refractory metal and a refractory emitter oxide containing an effective amount of a sintering activator or mixture thereof with a sintering aid compound; and (b) multiple layered composites comprising at least two layers of of mixtures of refractory metal and refractory emitter oxide or mixtures of said oxides, said layers having different volume fractions of emitter oxide or mixtures of emitter oxides, at least one of the layers containing an effective amount of a sintering activator or mixture thereof with a sintering aid compound, (b) depositing a first refractory metal powder/oxide emitter powder mixture to form a base layer;

(c) depositing at least a second refractory metal/oxide emitter powder mixture to form a top layer adjacent to the base layer;

(d) pressing the deposited layers to form a multilayered body; and (f) sintering said multilayered body at an elevated temperature effective to form a composite electrode having a density of at least about 85%, said elevated temperature being selected from the range of (i) a temperature at least above the temperature at which sintering of the refractory metal with activator is initiated and said composite density of at least 85% is achieved and (ii) a temperature below the temperature at which (x) sintering of the refractory metal without activator is initiated and (y) the emitter oxide and/or activator undergo substantial degradation.

2. A method as claimed in claim 1, wherein said composite is a single layer composite of a refractory metal and a refractory emitter oxide containing an effective amount of a sintering activator sintered at a temperature within the range of about 1100° C. to about 1400° C.

3. A method as claimed in claim 2 wherein said refractory metal is tungsten.

4. A method as claimed in claim 3, wherein said refractory emitter oxide is selected from the group of barium titanate, barium zirconate, barium strontium zirconate, barium tantalate, and mixtures thereof.

5. A method as claimed in claim 1, wherein said composite is a multiple layered composite comprising at least two layers of mixtures of refractory metal and refractory emitter oxide in which the layers have different volume fractions of emitter oxide or mixture of emitter oxides.

6. A method as claimed in claim 5, wherein said refractory metal is tungsten.

7. A method as claimed in claim 6, wherein said emitter oxide is Barium titanate.

8. A method as claimed in claim 6, wherein said emitter is barium zirconate.

9. A method as claimed in claim 9, wherein said emitter oxide is barium strontium zirconate.

10. A method as claimed in claim 6, wherein said emitter oxide is barium tantalate.

11. A method as claimed in claim 6, wherein said emitter oxide is barium yttriate.

12. A method as claimed in claim 1, wherein said activator is a Group VIIIa transition metal.

13. A method for producing a multiple layered composite electrode which comprises the steps of:

(a) mixing a refractory metal powder with different volumes of an oxide emitter powder;

(b) depositing a first refractory metal powder/oxide emitter powder mixture to form a base layer;

(c) depositing at least a second refractory metal/oxide emitter powder mixture to form a top layer adjacent to the base layer;

(d) pressing the deposited layers to form a multilayered body; and (f) sintering said multilayered body at an elevated temperature effective to form a composite electrode having a density of at least about 85%, said elevated temperature being selected from the range of (i) a temperature at least above the temperature at which sintering of the refractory metal with activator is initiated and said composite density of at least 85% is achieved and (ii) a temperature below the temperature at which (x) sintering of the refractory metal without activator is initiated and (y) the emitter oxide and/or activator undergo substantial degradation.

14. A method as claimed in claim 13 wherein said refractory metal is tungsten, and said activator is Ni.

15. A method as claimed in claim 14 wherein the elevated temperature is within the range of about 1100° C. to about 1400° C.

16. A fluorescent lamp which includes an electrode produced by the method of claim 13.

17. A method for producing a multiple layered composite electrode which comprises the steps of:

(a) mixing a refractory metal powder with different volumes of an oxide emitter powder;

(b) depositing a first refractory metal powder/oxide emitter powder mixture to form a base layer;

(c) depositing at least a second refractory metal/oxide emitter powder mixture to form a top layer adjacent to the base layer;

(d) pressing the deposited layers to form a multilayered body;

(f) sintering said multilayered body at an elevated temperature effective to form a composite electrode having a density of at least about 85%, said elevated temperature being selected from the range of (i) a temperature at least above the temperature at which sintering of the refractory metal with activator is initiated and said composite density of at least 85% is achieved and (ii) a temperature below the temperature at which (x) sintering of the refractory metal without activator is initiated and (y) the emitter oxide and/or activator undergo substantial degradation; and (g) removing refractory metal from the top layer of the electrode to a depth of about 10–50 $\mu$m by dipping the electrodes in a solution of hydrogen peroxide at a temperature of about 50° to about 80° C.

18. A method as claimed in claim 17 in which said elevated temperature is within the range of about 1100° to about 1400° C.

19. A fluorescent lamp which includes an electrode produced by the method of claim 17.

20. A method of forming a composite electrode which comprises the steps of:

(a) mixing a refractory metal powder with an oxide emitter powder and an effective amount of at least one sintering activator;

(b) pressing the mixture to form a composite body; and (f) sintering said composite body at a temperature within the range of about 1100° C. to about 1400° C.

21. A fluorescent lamp which includes an electrode produced by the method of claim 20.

22. A method of forming a composite electrode which comprises the steps of:

(a) mixing a refractory metal powder with an oxide emitter powder and an effective amount of at least one sintering activator;

(b) pressing the mixture to form a composite body;

(f) sintering said composite body at a temperature within the range of about 1100° C. to about 1400° C. and (g) removing refractory metal from the top layer of the electrode to a depth of about 10–50 $\mu$m by dipping the electrode in a solution of hydrogen peroxide at a temperature of about 50° to about 80° C.

23. A method as claimed in claim 22 wherein said refractory metal is tungsten, said activator is Ni, and said sintering temperature is about 1300° C.

24. A fluorescent lamp which includes an electrode produced by the method of claim 23.

25. A fluorescent lamp which includes an electrode produced by the method of claim 22.

26. A fluorescent lamp which includes an electrode which comprises a composite of a refractory metal and a refractory emitter oxide selected from the group consisting of (a) single layer composites of a refractory metal and a refractory emitter oxide containing an effective amount of a sintering activator or mixture thereof with a sintering aid; and (b) multiple layered composites comprising at least two layers of mixtures of refractory metal and refractory emitter oxide or mixtures of said oxides, said layers having different volume fractions of emitter oxide or mixtures of emitter oxides, at least one of the layers containing an effective amount of a sintering activator or mixture thereof with a sintering aid, said composites having been subjected to sintering at an elevated temperature effective to form a composite electrode having a density of at least about 85%, said elevated temperature being selected from the range of (i) a temperature at least above the temperature at which sintering of the refractory metal with activator is initiated and said composite density of at least 85% is achieved and (ii) a temperature below the temperature at which (x) sintering of the refractory metal without activator is initiated and (y) the emitter oxide and/or activator undergo substantial degradation.

27. A fluorescent lamp as claimed in claim 26, wherein said composite is a single layer composite of a refractory metal and a refractory emitter oxide containing an effective amount of a sintering activator sintered at a temperature within the range of about 1100° C. to about 1400° C.

28. A fluorescent lamp as claimed in claim 27, wherein said refractory metal is tungsten.

29. A fluorescent lamp as claimed in claim 28, wherein said refractory emitter oxide is selected from the group of barium titanate, barium zirconate, barium strontium zirconate, barium tantalate, and mixtures thereof.

30. A fluorescent lamp as claimed in claim 27, wherein said activator is a Group VIIIa transition metal.

31. A fluorescent lamp as claimed in claim 30, wherein said activator is Ni, and said composite also contains a sintering aid for the oxide.

32. A fluorescent lamp as claimed in claim 26, wherein said composite is a multiple layered composite comprising at least two layers of mixtures of refractory metal and refractory emitter oxide in which the layers have different volume fractions of emitter oxide or mixture of emitter oxides.

33. A fluorescent lamp as claimed in claim 32, wherein said refractory metal is tungsten.

34. A fluorescent lamp as claimed in claim 32, wherein said emitter oxide is barium titanate.

35. A fluorescent lamp as claimed in claim 32, wherein said emitter oxide is barium zirconate.

36. A fluorescent lamp as claimed in claim 32, wherein said emitter oxide is barium strontium zirconate.

37. A fluorescent lamp which includes a multiple layer composite electrode selected from the group of (1) a. Top layer: 75 vol. % $Ba_{0.5}Sr_{0.5}ZrO_3$+25 vol. % W+3 mol % $Li_2O$ of the amount of $Ba_{0.5}Sr_{0.5}ZrO_3$;

b. Bottom layer: 40 vol. % $Ba_{0.5}Sr_{0.5}ZrO_3$+60 vol. % W+3 mol % $Li_2O$ of the amount of the $Ba_{0.5}Sr_{0.5}ZrO_3$+0.2 wt. % Ni based on the amount of W; and (2) a. Top layer: 50 vol. % $BaTiO_3$+30 vol. % $Ba_2TiO_4$+20 vol. % W+0.2 wt. % Ni based on the amount of the W+3 mol % $Tio_2$ based on the amount of $BaTiO_3$ b. Bottom layer: 30 vol. % $BaTiO_3$+10 vol. % $Ba_2TiO_4$+60 vol. % W+0.2 wt. % Ni based on the amount of tungsten +3 mol % $TiO_2$ based on the amount of $BaTiO_3$.

* * * * *